US006765164B2

(12) United States Patent
Lee et al.

(10) Patent No.: US 6,765,164 B2
(45) Date of Patent: Jul. 20, 2004

(54) PUSH BUTTON

(75) Inventors: Hyun-Mu Lee, Suwon (KR); Ki-Su Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/421,752

(22) Filed: Apr. 24, 2003

(65) Prior Publication Data

US 2004/0094396 A1 May 20, 2004

(30) Foreign Application Priority Data

Nov. 20, 2002 (KR) ..... 2002-72343

(51) Int. Cl.[7] ..... H01H 13/70
(52) U.S. Cl. ..... 200/345; 200/341
(58) Field of Search ..... 200/517, 520, 200/521, 341, 344, 345

(56) References Cited

U.S. PATENT DOCUMENTS 5,066,841 A * 11/1991 Zoller et al. ..... 200/342
5,380,970 A * 1/1995 Mizuno et al. ..... 200/523
5,442,152 A * 8/1995 Huang ..... 200/345
5,512,722 A * 4/1996 Ozeki et al. ..... 200/517

FOREIGN PATENT DOCUMENTS

KR 2001-16269 3/2001 ..... H01H/13/14

* cited by examiner

*Primary Examiner*—Michael A. Friedhofer
(74) *Attorney, Agent, or Firm*—Staas & Halsey LLP

(57) ABSTRACT

A push button designed such that it is not damaged or broken even when an excessive external force is applied. The push button includes a control panel having a seat depression and a switch controlling a function. A button unit is seated in the seat depression so as to be movable by a predetermined distance. A push unit passes through the seat depression and moves by a force transmitted from the button unit to push the switch. The push button also has first and second springs having different spring constants. When a normal external force is applied, the second having a smaller spring constant, is elastically compressed to turn the switch on or off. When an excessive external force is applied, the first and second springs are elastically compressed to absorb external force, thus preventing components, such as the switch, from being damaged or broken.

16 Claims, 6 Drawing Sheets

PUSH BUTTON

CROSS-REFERENCE TO RELATED APPLICATIONS

This application claims the benefit of Korean Application No. 2002-72343, filed Nov. 20, 2002, in the Korean Intellectual Property Office, the disclosure of which is incorporated herein by reference.

BACKGROUND OF THE INVENTION

1. Field of the Invention

The present invention relates, in general, to push buttons and, more particular, to a push button which is designed such that it is not broken or damaged even when an excessive external force is applied to the push button.

2. Description of the Related Art

As is well known to those skilled in the art, a push button is a device which is provided on a control panel of various kinds of electrical devices to operate a switch installed inside the control panel so that the switch is turned on or off.

FIG. 1 illustrates a conventional push button.

The conventional push button 2 is installed in a seat depression 1*a* which is provided on a control panel 1. The push button 2 includes a cylindrical button unit 3 which is opened at its lower portion. A rod-shaped push unit 4 extends from the button unit 3, and passes through the seat depression 1*a* to push a switch 6 which is provided at a predetermined position inside the control panel 1. A spring 5 elastically biases the button unit 3 in a direction away from a bottom of the seat depression 1*a*.

Thus, when an external force is applied to the button unit 3, the spring 5 is compressed by the external force, so the button unit 3 and the push unit 4 are moved toward the switch 6. Due to the movement of the button unit 3 and the push unit 4, an end of the push unit 4 pushes the switch 6 so that the switch 6 is turned on or off. Meanwhile, when the external force is released from the button unit 3, the spring 5 is returned to its original position, thus returning the button unit 3 and the push unit 4 to their original positions.

However, the conventional push button 2 has a problem that, when an excessive external force is applied to the button unit 3, the external force is transmitted through the push unit 4 to the switch 6 and a circuit board 7 to which the switch 6 is mounted, so the switch 6 and the circuit board 7 may be damaged or broken.

Further, the conventional push button 2 has another problem that, when a user pushes the button unit 3 to press the switch 6 by the push unit 4, a reaction force opposite to the user's force is transmitted through the push unit 4 and the button unit 3 to the user, so a manipulation feeling is poor.

SUMMARY OF THE INVENTION

Accordingly, it is an aspect of the present invention to provide a push button, which is designed such that a switch or a circuit board is not damaged or broken even when an excessive external force is applied to the push button.

Another aspect of the present invention is to provide a push button having an excellent manipulation feeling.

A further aspect of the present invention is to provide an electrical device having the push button, which is designed such that a switch or a circuit board of the electrical device is not damaged or broken even when an excessive external force is applied to the push button.

Additional aspects and advantages of the invention will be set forth in part in the descripton which follows and, in part, will be obvious from the description, or may be leamed by practice of the invention.

The foregoing and/or other aspects of the present invention are achieved by providing a push button, including a control panel having a switch controlling a function, a seat depression provided on the control panel, a button unit seated in the seat depression in such a way as to be movable by a predetermined distance, a push unit passing through the seat depression and moving by a force transmitted from the button unit to push the switch, and first and second springs having different spring constants, respectively responding to the force transmitted from the button unit.

Further, the push unit includes a support part arranged between the button unit and the seat depression, and a push part extending from the support part and passing through the seat depression to push the switch. The first spring is provided between the button unit and the support part, and the second spring is provided between the support part and the seat depression, the first spring having a larger spring constant than the second spring.

In addition, the push unit integrally extends from the button unit, and the first and second springs are integrated into a single structure and provided between the button unit and the seat depression.

Further, the seat depression is provided with a locking hole to lock the button unit to the seat depression, with a through hole being provided on the seat depression to allow the push part to pass through the seat depression. The button unit is provided with a locking hook, the locking hook being locked to the locking hole of the seat depression so that the button unit is seated in the seat depression in such a way as to be movable by the predetermined distance.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
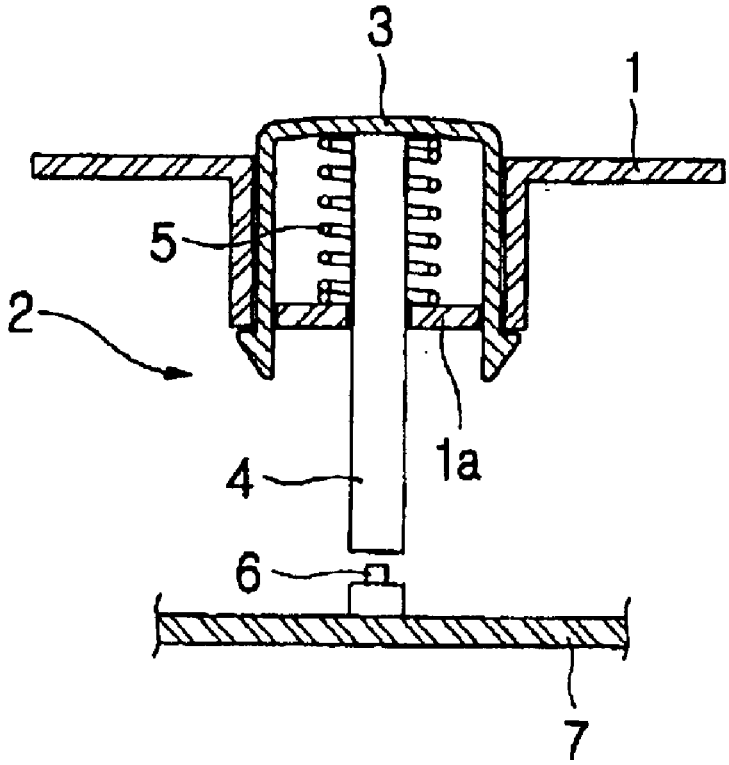
FIG. 1 (PRIOR ART)
FIG. 1 is a sectional view illustrating a conventional push button.

Reference will now be made in detail to the present preferred embodiments of the present invention, examples of which are illustrated in the accompanying drawings, wherein like reference numerals refer to like elements throughout.

Figure 2:
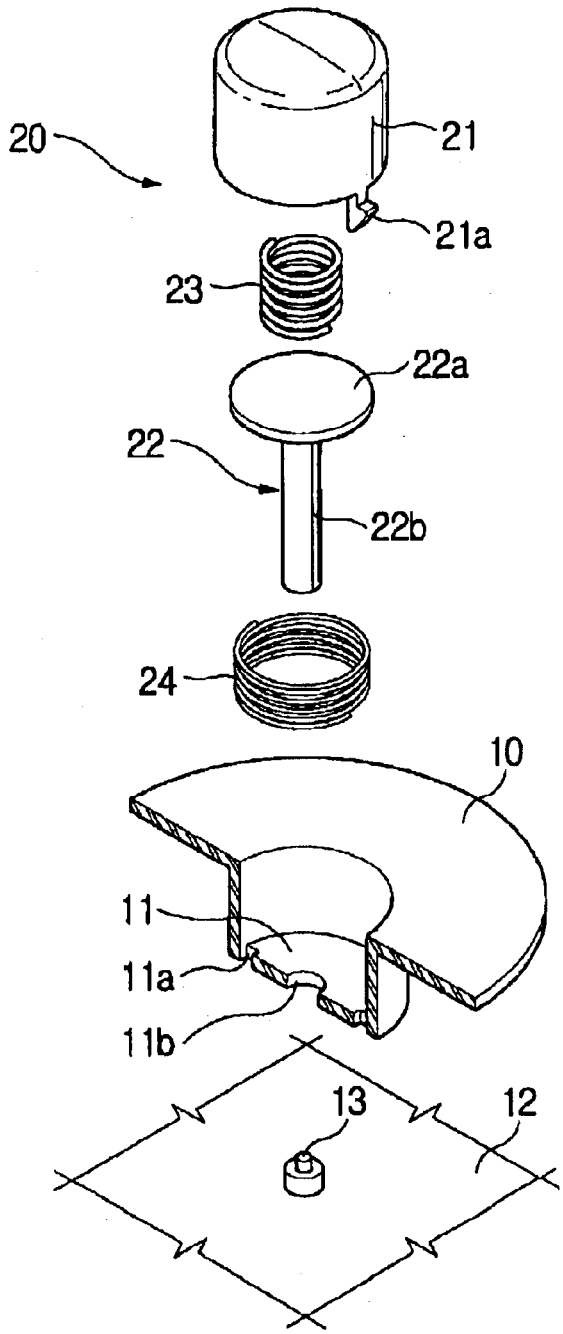
FIG. 2 is an exploded perspective view illustrating a push button according to a first embodiment of the present invention.
Figure 3:
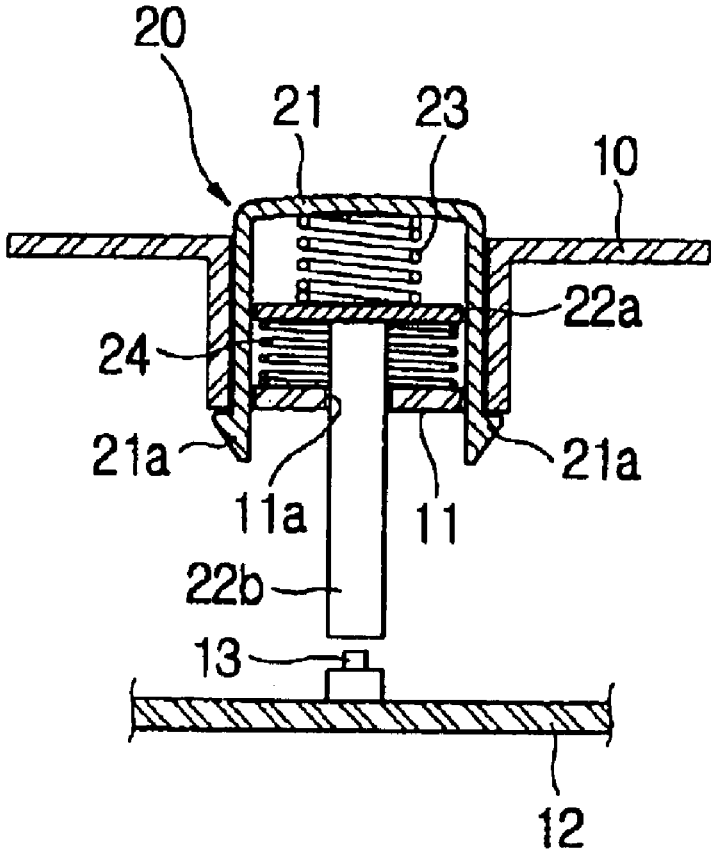
FIG. 3 is a sectional view of the push button according to the first embodiment of the present invention.

As illustrated in FIGS. 2 and 3, the push button according to a first embodiment of the present invention is mounted to a control panel 10 of various kinds of electrical devices, and is used to operate a switch 13 which is provided inside the control panel 10.

A circuit board 12 is installed in the control panel 10 to control the operation of the electrical device. The switch 13 is mounted to the circuit board 12. A circular seat depression 11 is provided on the control panel 10 in such a way as to be positioned above the switch 13. The push button 20 is mounted to the control panel 10 at the seat depression 11.

According to a first embodiment of the present invention, the push button 20 includes a button unit 21, a push unit 22, a first damping device, and a second damping device. The damping devices may be any of several known those skilled in the art, such as springs or fluid damping pots. In this embodiment, the damping devices will hereafter be referred to as a first spring 23 and a second spring 24.

The button unit 21 is seated in the seat depression 11. The push unit 22 includes a support part 22*a* and a push part 22*b*. The support part 22*a* is provided between the button unit 21 and the seat depression 11. The push part 22*b* extends from the support part 22*a* to pass through the seat depression 11. The first spring 23 is provided between the button unit 21 and the support part 22*a* to absorb an excessive external force applied to the button unit 21 or a reaction force generated from the switch 13. The second spring 24 is provided between the support part 22*a* and the seat depression 11 to elastically bias the push unit 22 in a direction away from the bottom of the seat depression 11.

The button unit 21 has a cylindrical shape which is opened at its lower portion. Two locking hooks 21*a* extend from a lower end of the button unit 21 so that the button unit 21 is seated in the seat depression 11 in such a way as to be movable by a predetermined distance. Further, two locking holes 11*a* are provided at a bottom of the seat depression 11 so that the locking hooks 21*a* are movably locked to the locking holes 11*a*.

The support part 22*a* of the push unit 22 has a disc shape so that a lower end of the first spring 23 and an upper end of the second spring 24 are supported at upper and lower surfaces of the support part 22*a*, respectively. The support part 22*a* is designed to be movable in a vertical direction in response to an external force and the interaction between the two springs 23 and 24.

The push part 22*b* of the push unit 22 downwardly extends from a center of the support part 22*a*, and sequentially passes the center of the second spring 24 and the bottom of the seat depression 11*b*. In this case, the push part 22*b* is installed in such a way that its lower end is spaced apart from the switch 13 by a predetermined interval in a normal state. Thus, when the button unit 21 is pushed by an external force, the external force is transmitted to the support part 22*a* through the first spring 23. At this time, the push unit 22 is downwardly moved to operate the switch 13 so that the switch 13 is turned on or off. In order to allow the push part 22*b* to pass through the seat depression 11, the seat depression 11 is provided with a through hole 11*b* at the bottom.

The first and second springs 23 and 24 are provided between the button unit 21 and the seat depression 11 to elastically bias the button unit 21 and the support part 22*a*. When a normal external force is applied to the button unit 21, only the second spring 24 is elastically compressed to move the push unit 22 to the switch 13, so that the switch 13 is turned on or off. Meanwhile, when an excessive external force is applied to the button unit 21, the first and second springs 23 and 24 are elastically compressed, so that the first spring 23 absorbs the excessive external force and the second spring 24 moves the push unit 22 to operate the switch 13. For such operations of the springs 23 and 24, the first spring 23 has a relatively larger spring constant than the second spring 24.

For a dear description of the drawings, upper and lower positions are designated herein. But, the arrangement of the push button according to the present invention is not limited to these positions.

The operation and effect of the push button according to the present invention will be described in the following in detail with reference to the drawings.

Figure 4:
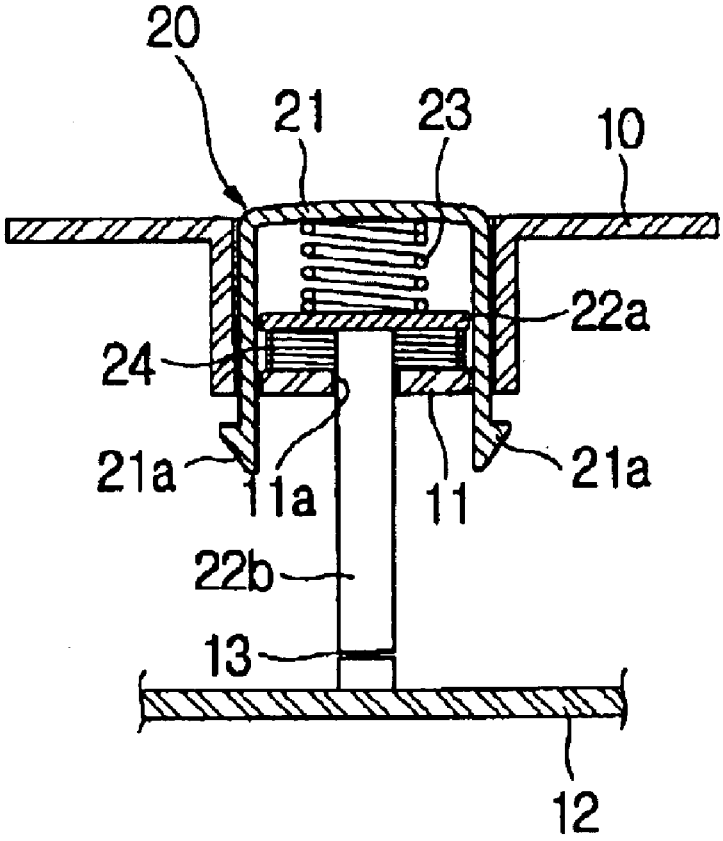
FIG. 4 is a sectional view of the push button according to the first embodiment of the present invention, when a normal external force is applied to the push button.

When a normal external force is applied to the button unit 21, as illustrated in FIG. 4, the second spring 24, having a smaller spring constant in comparison with the first spring 23, is elastically compressed. At this time, the button unit 21 and the push unit 22 are downwardly moved, so the lower end of the push part 22*b* pushes the switch 13. The switch 13 is thus turned on or off.

Subsequently, when the external force is released from the button unit 21, the button unit 21 and the push unit 22 are returned to their original positions by a restoring force of the second spring 24.

Meanwhile, when an excessive external force is applied to the button unit 21, the second spring 24, having a smaller spring constant than the first spring 23, is primarily and elastically compressed, in the same manner as when the normal external force is applied to the button unit 21. At this time, the button unit 21 and the push unit 22 are downwardly moved, so the lower end of the push part 22*b* pushes the switch 13 so that the switch 13 is turned on or off.

However, since the external force applied to the button unit 21 in this state exceeds an elastic force of the second spring 24, the excessive external force is not completely absorbed by the second spring 24.

Figure 5:
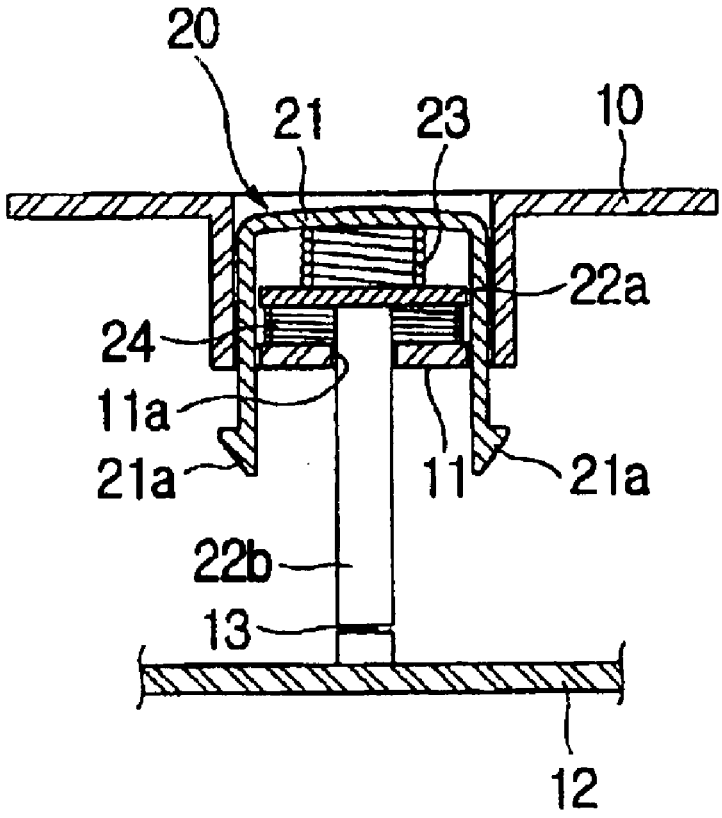
FIG. 5 is a sectional view of the push button according to the first embodiment of the present invention, when an excessive external force is applied to the push button.

Thus, after the second spring 24 is elastically deformed, the first spring 23 is elastically compressed, as illustrated in FIG. 5. When the first spring 23 is elastically deformed as described above, the push unit 22 does not remove but only the button unit 21 moves downwards, thus effectively absorbing the excessive force applied to the button unit 21.

That is, the excessive force applied to the push button 20 is absorbed by the first spring 23, so the force is not transmitted to the switch 13 or the circuit board 12 to which the switch 13 is mounted.

Further, when a user pushes the button unit 21, a reaction force acing between the push unit 22 and the switch 13 is absorbed by the first spring 23, thus providing an excellent manipulation feeling to the user.

Figure 6:
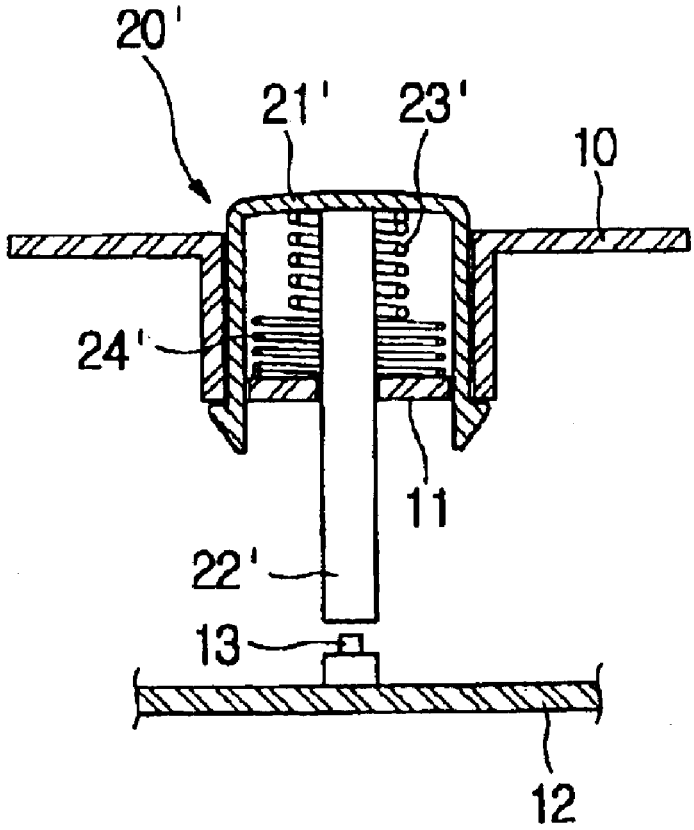
FIG. 6 is a sectional view illustrating a push button according to a second embodiment of the present invention.

FIG. 6 illustrates a push button 20 according to a second embodiment of the present invention.

According to the second embodiment of the present invention, the push button 20 includes a button unit 21', a push unit 22', a first spring 23', and a second spring 24'. During an operation of the push button 20', an external force is applied to the button unit 21'. The push unit 22' integrally extends from the button unit 21', and moves along with the button unit 21' to push the switch 13 so that the switch 13 is turned on or off. The first and second springs 23' and 24' having different spring constants are integrated into a single structure.

When an external force is applied to the button unit 21', one of the two springs 23' and 24', that is, the first spring 23' or the second spring 24' having a relatively smaller spring constant, is primarily and elastically compressed so that the push unit 22' operates the switch 13. In such a state, when the external force is further applied to the button unit 21', the other spring 23' or 24' having a relatively larger spring constant is secondarily and elastically compressed, thus absorbing the external force.

As is apparent from the above description, the present invention provides a push button, which is provided with a first spring having a larger spring constant between a button unit and a support part of a push unit, thus allowing an excessive external force to be absorbed even when the excessive external force is applied to the button unit, therefore preventing the excessive external force from being transmitted to a switch or a circuit board provided below the push button.

Further, the push button of the present invention allows a reaction force, acting between the push unit and the switch when the push unit pushes the switch, to be absorbed by the first spring having a larger spring constant, thus providing an excellent manipulation feeling.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A push button, comprising:

a control panel having a switch controlling a function;

a seat depression provided on said control panel;

a button unit seated in the seat depression, to be movable by a predetermined distance;

a push unit passing through the seat depression and moving by a force transmitted from the button unit to push the switch; and first and second springs having different spring constants respectively responding to the force transmitted from the button unit.

2. The push button as set forth in claim 1, wherein:

said push unit comprises:

a support part arranged between the button unit and the seat depression; and a push part extending from the support part and passing through the seat depression to push the switch; and said first spring is provided between the button unit and the support part, and said second spring is provided between the support part and the seat depression, said first spring having a larger spring constant than the second spring.

3. The push button as set forth in claim 2, wherein:

said seat depression has a locking hole to lock the button unit to the seat depression;

said seat depression has a through hole to allow the push part to pass through the seat depression; and said button unit has a locking hook, said locking hook being locked to an edge of the locking hole of the seat depression so that the button unit is seated in the seat depression to be movable by the predetermined distance.

4. The push button as set forth in claim 1, wherein:

said push unit integrally extends from the button unit; and said first and second springs are integrated into a single structure and provided between the button unit and the seat depression.

5. The push button as set forth in claim 4, wherein:

said seat depression has a locking hole to lock the button unit to the seat depression;

said seat depression has a through hole to allow the push part to pass through the seat depression; and said button unit has a locking hook, said locking hook being locked to an edge of the locking hole of the seat depression so that the button unit is seated in the seat depression to be movable by the predetermined distance.

6. The push button as set forth in claim 1, wherein:

the button unit has an approximately cylindrical shape; and the seat depression has an approximately circular shape.

7. An electrical device, comprising:

a push button comprising:

a control panel having a switch controlling a function of the electrical device, a seat depression provided on said control panel, a button unit seated in the seat depression in such a way as to be movable by a predetermined distance, a push unit passing through the seat depression and moving by a force transmitted from the button unit to push the switch, and first and second springs having different spring constants respectively responding to the force transmitted from the button unit.

8. The electrical device as set forth in claim 7, wherein:

said push unit comprises:

a support part arranged between the button unit and the seat depression; and a push part extending from the support part and passing through the seat depression to push the switch; and said first spring is provided between the button unit and the support part, and said second spring is provided between the support part and the seat depression, said first spring having a larger spring constant than the second spring.

9. The electrical device as set forth in claim 8, wherein:

said seat depression has a locking hole to lock the button unit to the seat depression;

said seat depression has a through hole to allow the push part to pass through the seat depression; and said button unit has a locking hook, said locking hook being locked to an edge of the locking hole of the seat depression so that the button unit is seated in the seat depression to be movable by the predetermined distance.

10. The electrical device as set forth in claim 7, wherein:

said push unit integrally extends from the button unit; and said first and second springs are integrated into a single structure and provided between the button unit and the seat depression.

11. The electrical device as set forth in claim 10, wherein:

said seat depression has a locking hole to lock the button unit to the seat depression;

said seat depression has a through hole to allow the push part to pass through the seat depression; and said button unit has a locking hook, said locking hook being locked to an edge of the locking hole of the seat depression so that the button unit is seated in the seat depression to be movable by the predetermined distance.

12. A push button comprising:

a control panel having a switch controlling a function;

a seat depression provided on said control panel;

a button unit seated in the seat depression that is movable by a predetermined distance;

a push unit capable of transmitting force from the button unit to the switch; and a plurality of damping devices respectively responding to force transmitted from the button unit to the switch.

13. The push button as set forth in claim 12, wherein:

the plurality of damping devices have different damping coefficients.

14. The push button as set forth in claim 12, wherein:

the plurality of damping devices are springs.

15. The push button as set forth in claim 12, wherein:

said push unit comprises:

a support part arranged between the button unit and the seat depression; and a push part extending from the support part to push the switch;

the plurality of damping devices comprises:

a first damping device provided between the button unit and the support part; and a second damping device provided between the support part and the seat depression; and the first damping device has a greater damping coefficient than the second damping device.

16. An apparatus, comprising:

a switch;

a push unit transmitting force to the switch;

a button unit transmitting force to the push unit; and first and second damping devices, said second damping device being primarily and elastically compressed in response to a first force on the button unit of sufficient magnitude to activate the switch, and in response to a second force on the button unit greater than the first force, the difference between the first and second forces is absorbed by the first damping device, and is not transmitted to the push unit.

* * * * *

UNITED STATES PATENT AND TRADEMARK OFFICE

CERTIFICATE OF CORRECTION

PATENT NO. : 6,765,164 B2
APPLICATION NO. : 10/421752
DATED : July 20, 2004
INVENTOR(S) : Hyun-Mu Lee et al.

It is certified that error appears in the above-identified patent and that said Letters Patent is hereby corrected as shown below:

Title Page, Item (57) Abstract, line 1 insert --,-- after “button”,
line 10, insert --spring-- after “second”,
line 13, insert --the-- after “absorb”.

Signed and Sealed this

Eighth Day of January, 2008

JON W. DUDAS
*Director of the United States Patent and Trademark Office*

UNITED STATES PATENT AND TRADEMARK OFFICE

CERTIFICATE OF CORRECTION

PATENT NO. : 6,765,164 B2
APPLICATION NO. : 10/421752
DATED : July 20, 2004
INVENTOR(S) : Hyun-Mu Lee et al.

It is certified that error appears in the above-identified patent and that said Letters Patent is hereby corrected as shown below:

Column 8, line 20, insert

--17. The push button as set forth in claim 12, wherein:

the plurality of damping devices comprises first and second damping devices; and the first and second damping devices are integrated into a single structure provided between the button unit and the seat depression.--

Signed and Sealed this

Tenth Day of November, 2009

David J. Kappos

David J. Kappos
*Director of the United States Patent and Trademark Office*